US011164710B2

(12) United States Patent
Miyata et al.

(10) Patent No.: US 11,164,710 B2
(45) Date of Patent: Nov. 2, 2021

(54) BRUSH SWITCH WITH RESISTORS AND MANUFACTURING METHOD THEREOF

(71) Applicant: Mik Electronic Corporation, Tokyo (JP)

(72) Inventors: Muneyoshi Miyata, Tokyo (JP); Naoya Nakayama, Tokyo (JP)

(73) Assignee: Mik Electronic Corporation, Tokyo (JP)

( * ) Notice: Subject to any disclaimer, the term of this patent is extended or adjusted under 35 U.S.C. 154(b) by 158 days.

(21) Appl. No.: 16/517,557

(22) Filed: Jul. 20, 2019

(65) Prior Publication Data

US 2020/0083006 A1 Mar. 12, 2020

(30) Foreign Application Priority Data

Sep. 12, 2018 (JP) ..... JP2018-170282

(51) Int. Cl.
*H01H 21/24* (2006.01)
*H01H 21/12* (2006.01)
*H01H 21/86* (2006.01)

(52) U.S. Cl.
CPC ..... *H01H 21/24* (2013.01); *H01H 21/12* (2013.01); *H01H 21/86* (2013.01); *H01H 2205/002* (2013.01)

(58) Field of Classification Search
CPC ..... H01H 21/24; H01H 21/12; H01H 21/86; H01H 2205/002; H01H 3/16; H01H 13/18; H01H 1/44; H01H 13/10; H01H 13/12; H01H 19/42; H01H 1/40; H01H 23/08; H01H 23/12; H01H 23/02; H01H 23/168; H01H 11/00
See application file for complete search history.

(56) References Cited

U.S. PATENT DOCUMENTS 5,278,370 A * 1/1994 Miyata ..... H01H 21/24 200/244
9,959,987 B2 * 5/2018 Tanaka ..... H01H 11/0056
2020/0258697 A1 * 8/2020 Umezu ..... H01H 13/10

FOREIGN PATENT DOCUMENTS

JP 2015-072894 A 4/2015

* cited by examiner

*Primary Examiner* — Lheiren Mae A Caroc
(74) *Attorney, Agent, or Firm* — Muncy, Geissler, Olds & Lowe, P.C.

(57) ABSTRACT

A brush switch with resistors includes a case, a fixed contact point pattern that is fixed to the case, a lever that is supported by the case in an inclinable manner, and a movable contact point brush that is movable by an operation of the lever such that the movable contact point either contacts to or does not contact to the fixed contact point. Wherein the fixed contact point pattern has multiple fixed contact points that are disposed separated from one another in the case, and multiple terminals each of which is connected to the multiple fixed contact points, and the movable contact point brush has multiple contact point spring pieces that separate from or contact with the multiple fixed contact points, respectively, and multiple resistors, which have different resistance values, that are attached to spaces between the multiple contact point spring pieces.

3 Claims, 13 Drawing Sheets

BRUSH SWITCH WITH RESISTORS AND MANUFACTURING METHOD THEREOF

TECHNICAL FIELD

This invention relates to a brush switch with resistors used as a detection switch in a vehicle-mounted electronic control unit (ECU) circuit, and its manufacturing method.

BACKGROUND

Conventionally known as this kind of switch used in an ECU circuit is a switching device described in Patent Document 1 mentioned below. This switching device is a switch where at least two of a common fixed contact point, a first switching fixed contact point, and a second switching fixed contact point are extended inside a case that is above a holding member to form an extended part, and a resistors is attached to an attaching part formed on part of the extended part.

RELATED ART

[Patent Doc. 1] JP Laid-Open Patent Application Publication 2015-72894

By the way, according to the switching device of Patent Document 1, the attaching method of the resistors is that a supporting wall part is erected on the holding member, a recessed part is installed on the extended part held by the supporting wall part, and a chip resistor is accommodated and soldered in the recessed part. However, because this recessed part that accommodates the chip resistor is installed on a side face of the complex-shaped supporting wall part, it is not a structure fit for soldering by a solder printer, chip mounter, or a surface mounting device that automatically carries it with a reflow furnace or the like. Therefore, it requires a process to solder the resistor manually one by one, causing a problem that it is not fit for mass production and induces a large increase in the manufacturing cost.

Then, this invention has been made in order to solve such a problem, and its objective is to offer a brush switch with resistors and its manufacturing method that can greatly enhance productivity.

SUMMARY

A brush switch with resistors, which is disclosed in the application, includes a case, a fixed contact point pattern that is fixed to the case, a lever that is supported by the case in an inclinable manner, and a movable contact point brush that is movable by an operation of the lever such that the movable contact point either contacts to or does not contact to the fixed contact point. Wherein the fixed contact point pattern has multiple fixed contact points that are disposed separated from one another in the case, and multiple terminals each of which is connected to the multiple fixed contact points, and the movable contact point brush has multiple contact point spring pieces that separate from or contact with the multiple fixed contact points, respectively, and multiple resistors, which have different resistance values, that are attached to spaces between the multiple contact point spring pieces.

In the brush switch with resistors, the multiple resistors may be made by mounting and soldering chip resistors into a mold frame that isolates the spaces between the multiple contact point spring pieces from one another.

In the brush switch with resistors, the movable contact point brush may be integrated by fitting and fixing the mold frame to a recessed part of the lever.

A manufacturing method of a brush switch with resistors, disclosed in the application, includes a process of press molding a movable contact point pattern that includes multiple contact point spring pieces on a sheet of metal plate; a process of plating the movable contact point pattern, which is press-molded; a process of hoop-insert molding a mold frame that is made of a resin on the movable contact point pattern, which is plated; a process of mounting and soldering a chip resistor into the mold frame, which is hoop-insert molded such that the chip resistor is soldered to the movable contact point pattern; a process of press molding a movable contact point brush by cutting the movable contact point pattern to which the chip resistor is soldered into multiple contact point spring pieces and bending them; a process of fitting and fixing the mold frame of the movable contact point brush, which is press-molded, into a recessed part of a lever; and a process of assembling the lever, which is the integrated with the movable contact point brush, to a case where a fixed contact point pattern is insert-molded.

According to this invention, a switch having resistors attached to a movable contact point brush can be manufactured by hoop-insert molding a mold frame in a movable contact point pattern made of a sheet of metal plate constituting the movable contact point brush and mounting and soldering the chip resistors inside the mold frame. Thereby, because it becomes possible to attach the resistors to a large number of units of the movable contact point pattern using a surface mounting device with automatic carriage, having the advantages that production efficiency can be greatly enhanced and that the manufacturing cost can be greatly reduced by mass production.

BRIEF DESCRIPTIONS OF THE DRAWINGS

FIG. 12A is a cross-sectional view of a free position, FIG. 12B is a cross-sectional view of .an ON position, and FIG. 12C is a cross-sectional view of a fully-moved position.

Below, an embodiment of this invention is explained referring to drawings.

Figure 1A:
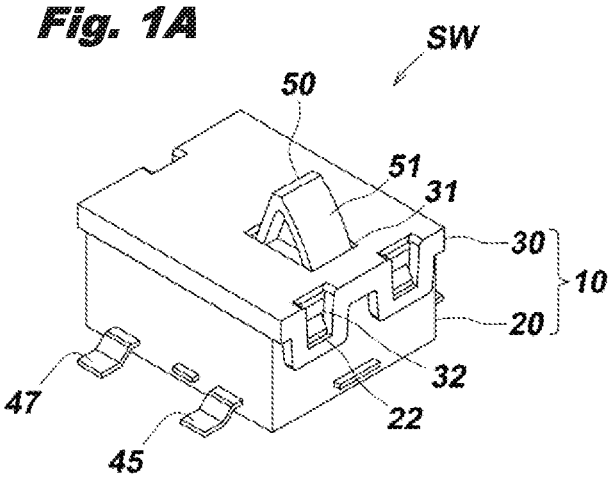
FIG. 1A is a perspective view showing the external appearance of a brush switch with resistors of this invention.
Figure 1B:
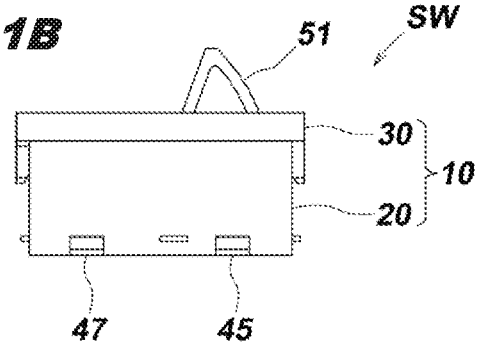
FIG. 1B is a front view of the same switch.
Figure 1C:
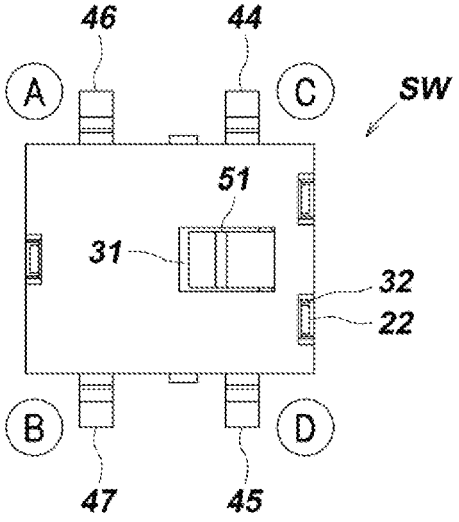
FIG. 1C is a plan view of the same switch.
Figure 1D:
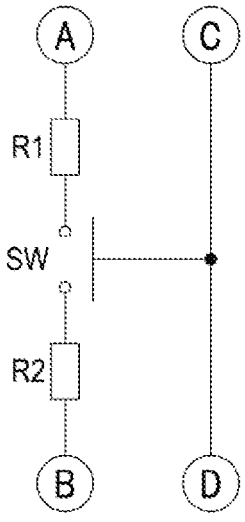
FIG. 1D is the circuit configuration diagram of the same switch.
Figure 2:
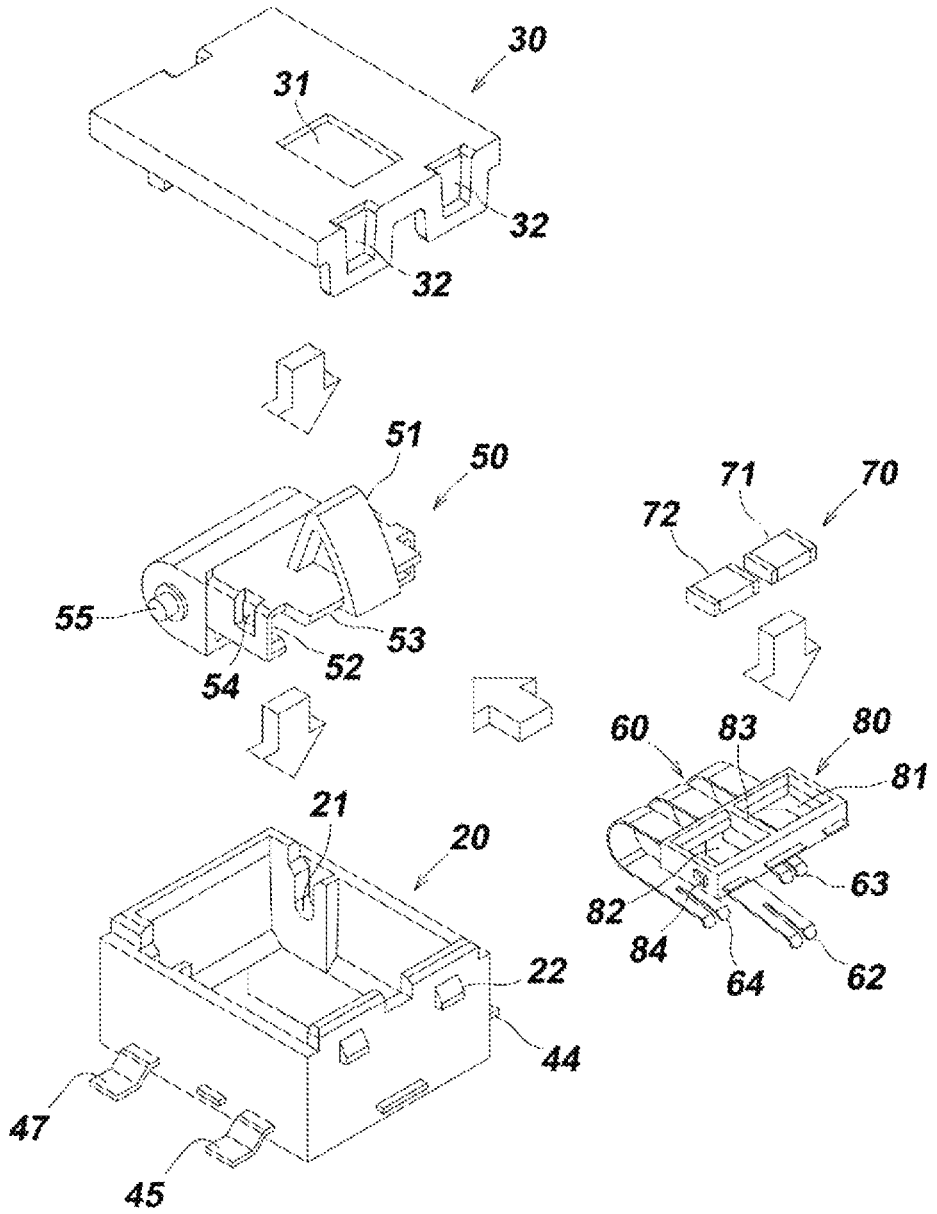
FIG. 2 is an exploded perspective view showing the internal structure of the brush switch with resistors of this invention.

As shown in FIG. 1 and FIG. 2, a brush switch SW with resistors of this invention is configured of a fixed contact point pattern 40, a lever 50, and a movable contact point brush 60 provided inside a box-shaped case 10 comprising a base 20 and a top case 30. By attaching multiple resistors 70 (71 and 72) to the movable contact point brush 60 and having it built in the case 10, stabilization and miniaturization of the circuit can be achieved compared with a switch having the resistors 70 externally attached.

Also, this switch SW is used as a detection switch for a vehicle-mounted ECU circuit. By attaching the resistors 71 (R1) and 72 (R2) having different resistance values, different outputs in three patterns of C-A circuit, C-B circuit, and A-B circuit can be obtained as shown in FIG. 1D according to the operation of the lever 50, therefore these three different functions can be controlled from a microcomputer side.

Below, explanations are given on the detailed structure of the brush switch SW with resistors according to its manufacturing method.

Figure 3A:
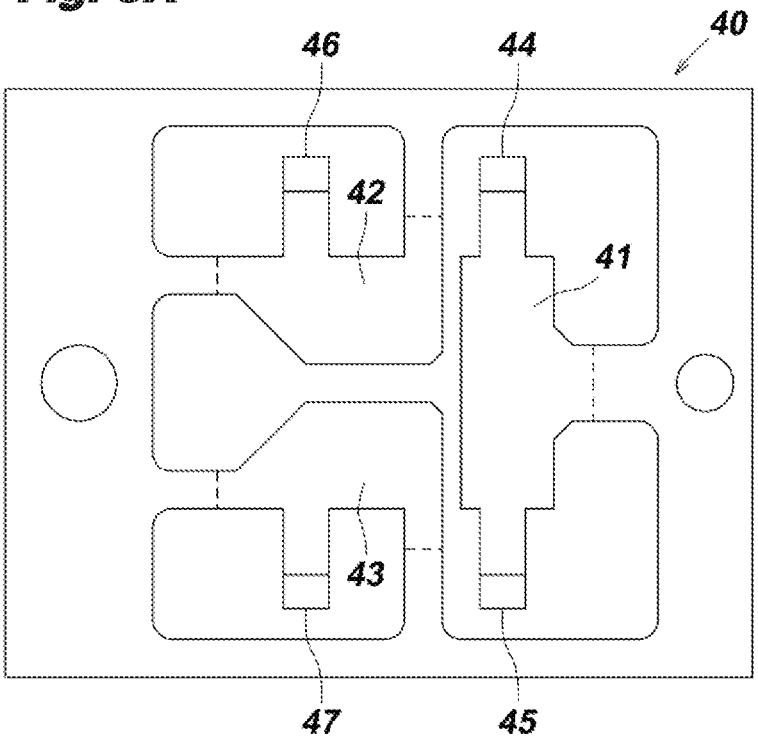
FIG. 3A is a plan view of a fixed contact point pattern in the same switch.
Figure 3B:
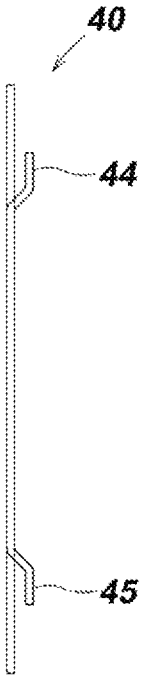
FIG. 3B is a side view of it.
Figure 4A:
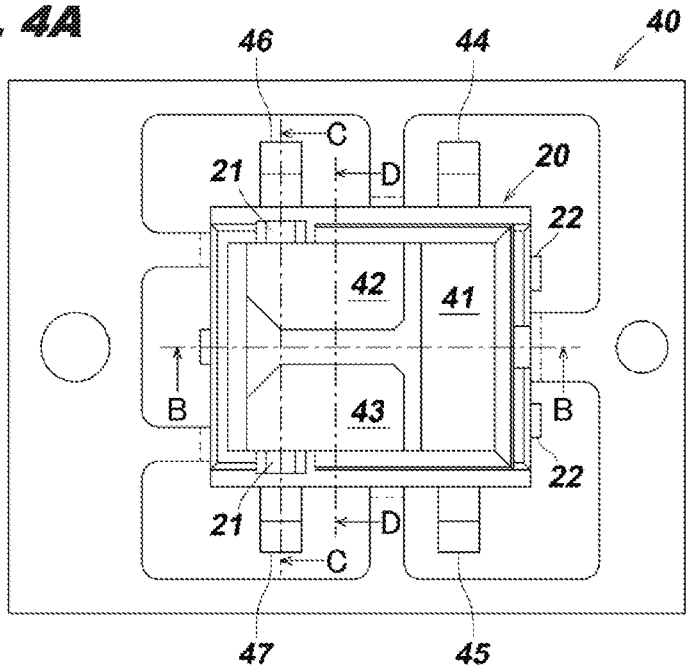
FIG. 4A is a plan view of a base in the same switch.
Figure 4B:
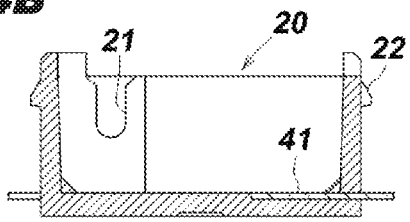
FIG. 4B is a B-B cross-sectional view.
Figure 4C:
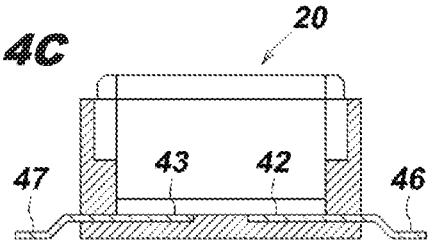
FIG. 4C is a C-C cross-sectional view.
Figure 4D:
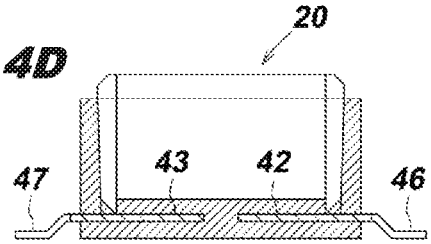
FIG. 4D is a D-D cross-sectional view.

As shown in FIG. 3, the fixed contact point pattern 40 is made by disposing multiple fixed contact points on a sheet of metal plate (brass in this embodiment) having conductivity and press molding it. A fixed contact point 41 disposed in the right side of the figure is a common fixed contact point, to which connected are two terminals (a power supply terminal 44 and a grounding terminal 45) made by bending its both ends. Also, fixed contact points 42 and 43 disposed in the left side of the figure are a first fixed contact point and a second fixed contact point, to which connected are terminals (a first output terminal 46 and a second output terminal 47, respectively) made by bending an end part of each. Note that broken lines in the figure are cut lines.

As shown in FIG. 4, the fixed contact point pattern 40 is insert-molded to the base 20 made of a conductive resin material (a polyamide resin in this embodiment), and afterwards cut by a press along the broken lines. Thereby, the common fixed contact point 41, the first fixed contact point 42, and the second fixed contact point 43 are disposed in a mutually insulated state on the bottom face inside the base 20, and the power supply terminal 44, the grounding terminal 45, the first output terminal 46, and the second output terminal 47 are disposed outside the base 20.

Figure 5A:
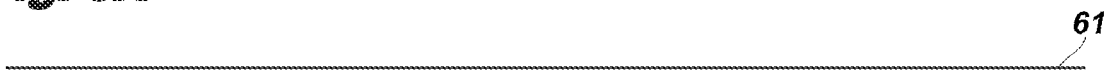
FIG. 5A is a front view and FIG. 5B is a plan view showing the manufacturing process of press molding movable contact point patterns in the manufacturing method of this invention.
Figure 5B:
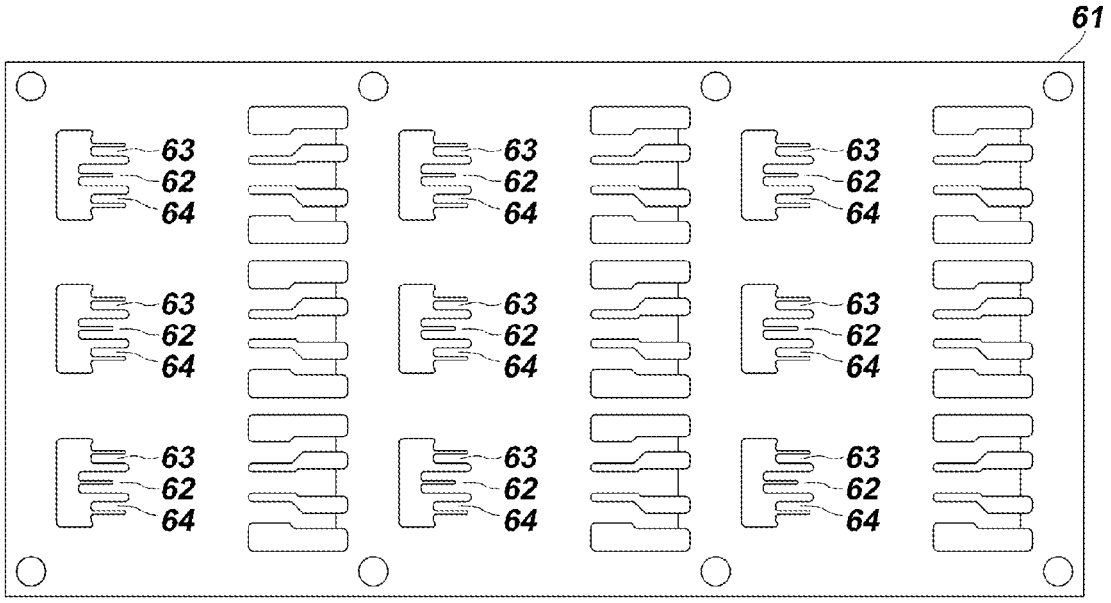

As shown in FIGS. 5A and 5B, a movable contact point pattern 61 to form the movable contact point brushes 60 is made by disposing multiple contact point spring pieces on a metal plate (phosphor bronze in this embodiment) having conductivity and a superior spring property, and press molding it. Here, in this embodiment, the movable contact point patterns 61 are disposed in three rows and three columns on a sheet of metal plate, and a large number of cavities are made inside one metal mold, thereby productivity can be greatly enhanced. On each movable contact point pattern 61, disposed in the center is a part to become a common contact point spring piece 62, and disposed on both sides of it are parts to become the first contact point spring piece 63 and the second contact point spring piece 64 that are shorter than the common contact point spring piece 62.

Figure 6A:
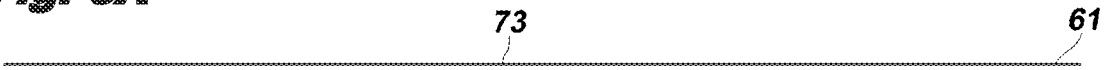
FIG. 6A is a front view and FIG. 6B is a plan view showing the manufacturing process of plating the movable contact point patterns in the manufacturing method of this invention.
Figure 6B:
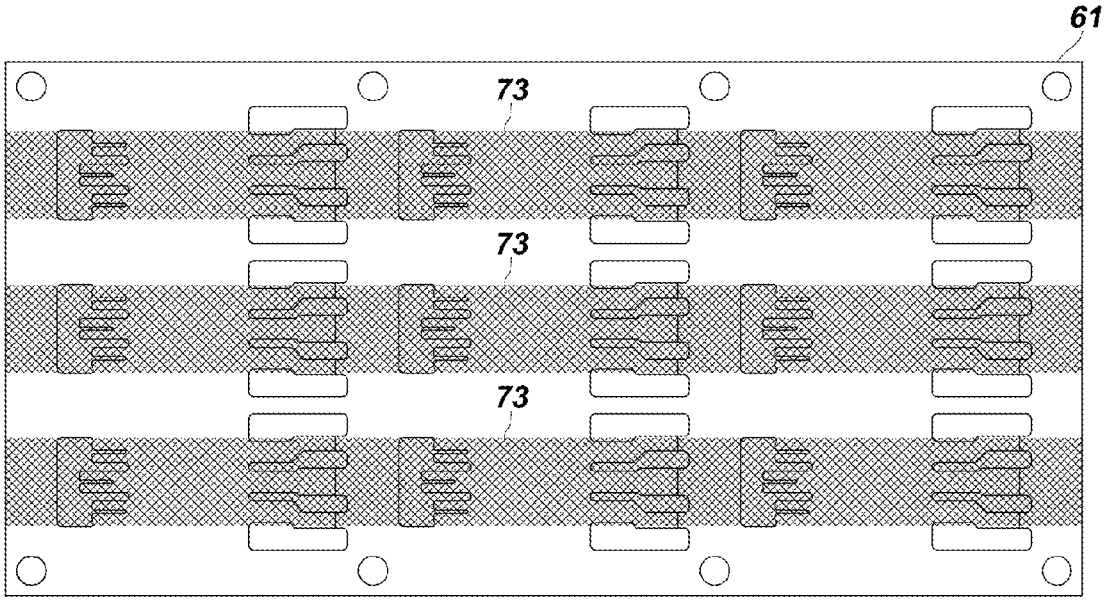

Next, as shown in FIGS. 6A and 6B, a plating process is performed on each movable contact point pattern 61. The plating process is for improving the wettability of a solder paste 74 mentioned below, and a coating 73 is formed with a prescribed thickness by silver plating only on the contact point spring pieces (the common contact point spring piece 62, the first contact point spring piece 63, and the second contact point spring piece 64) of each movable contact point pattern 61.

Figure 7A:
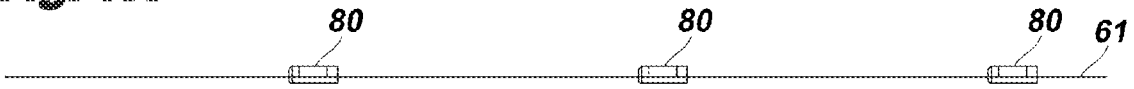
FIG. 7A is a front view and FIG. 7B is a plan view showing the manufacturing process of hoop-insert molding mold frames on the movable contact point patterns in the manufacturing method of this invention.
Figure 7B:
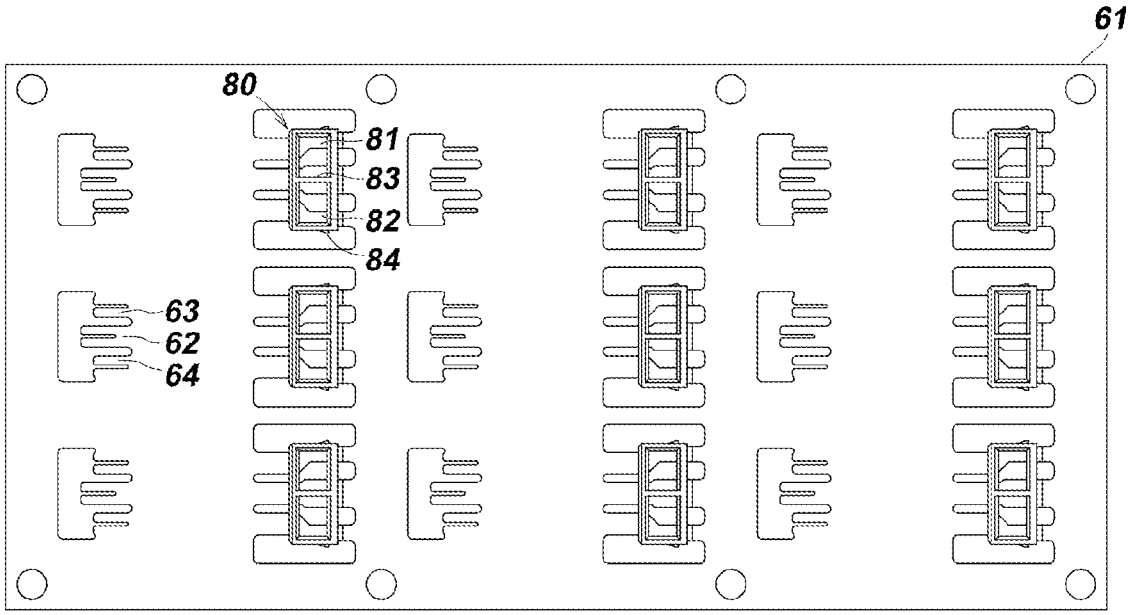

Next, as shown in FIGS. 7A and 7B, a mold frame 80 is hoop-insert molded on each of the plated movable contact point patterns 61. The mold frame 80 is a positioning part for attaching the resistors 70, and becomes integrated with the movable contact point pattern 61 through hoop-insert molding an insulating resin material (a polyamide resin in this embodiment) nipping the metal plate. Note that the installation position of the mold frame 80 is set to the root part of the contact point spring pieces, and it is partitioned into a first accommodation part 81 between the common contact point spring piece 62 and the first contact point spring piece 63, and a second accommodation part 82 between the common contact point spring piece 62 and the second contact point spring piece 64 according to the sizes of the resistors 70. Also, a partition wall 83 is formed in the central part of the mold frame 80 and set so as to isolate the first accommodation part 81 and the second accommodation part 82 from each other.

Figure 8A:
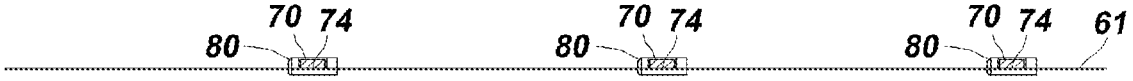
FIG. 8A is a front view and FIG. 8B is a plan view showing the manufacturing process of mounting and soldering chip resistors inside the mold frames in the manufacturing method of this invention.
Figure 8B:
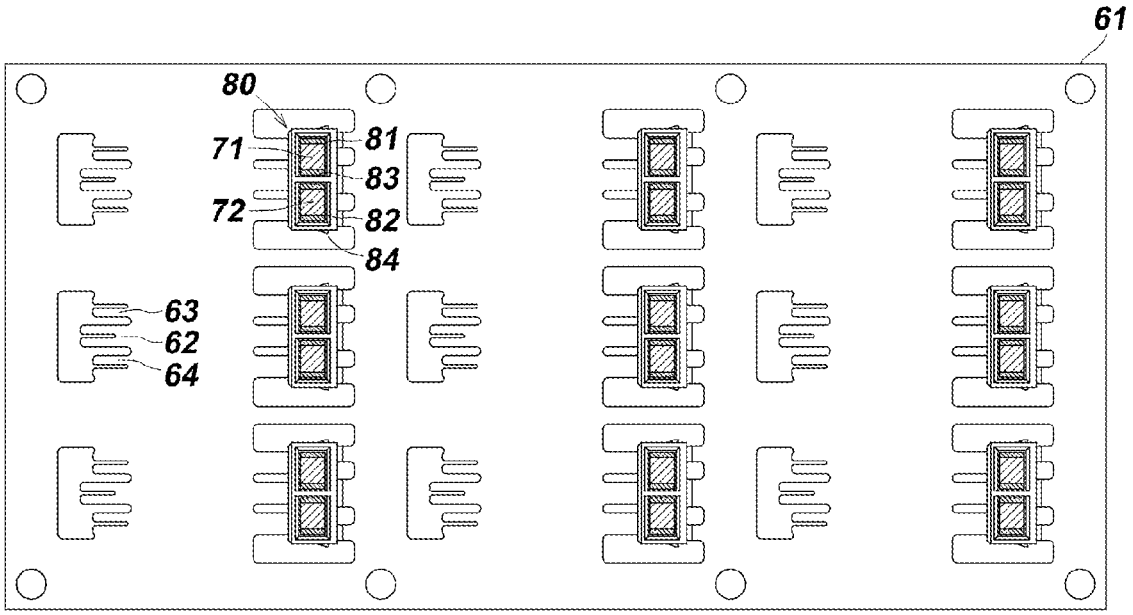

Subsequently, as shown in FIGS. 8A and 8B, the resistors 70 are mounted inside the hoop-insert molded mold frame 80, and soldering is performed. In this embodiment, using a surface mounting device with automatic carriage, the solder paste 74 is pasted on the inside of the first accommodation part 81 and the second accommodation part 82 of the mold frame 80 using a solder paste printer. Afterwards, two rectangular chip resistors having different resistance values (a first chip resistor 71 and a second chip resistor 72) are mounted into the first accommodation part 81 and the second accommodation part 82 using a chip mounter, respectively. Then, the solder paste 74 is melted by heating with a reflow furnace, and the two chip resistors 71 and 72 are fixed by soldering onto the movable contact point pattern 61. Note that because the partition wall 83 is installed in the mold frame 80 into which the chip resistors 71 and 72 are mounted, a mounting defect due to a bridge of the solder paste 74 can be prevented.

Figure 9A:
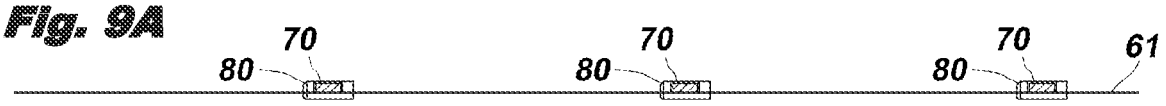
FIG. 9A is a front view and FIG. 9B is a plan view showing the manufacturing process of cutting each movable contact point pattern into multiple contact point spring pieces in the manufacturing method of this invention.
Figure 9B:
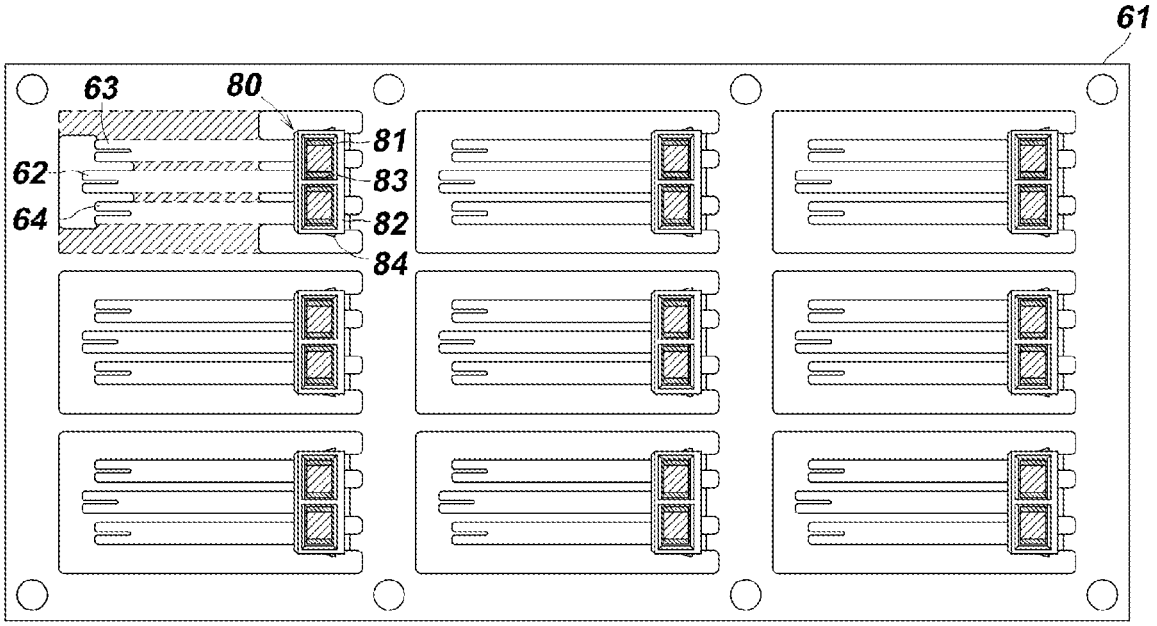

Next, as shown in FIG. 9A and 9B, the movable contact point pattern 61 having the chip resistors 71 and 72 soldered is cut into multiple contact point spring pieces. That is, by performing a cutting process with a press to hatched parts in the figure, the common contact point spring piece 62, the first contact point spring piece 63, and the second contact point spring piece 64 are separately formed on the movable contact point pattern 61.

Figure 10A:
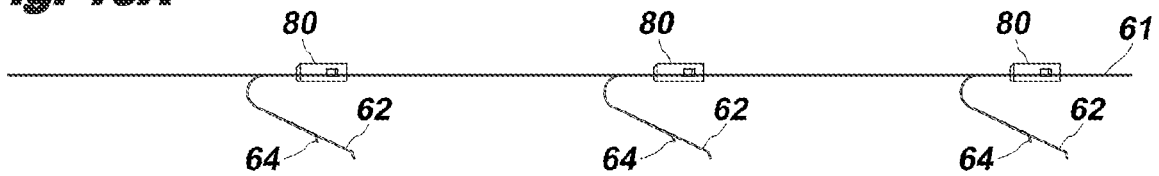
FIG. 10A is a front view and FIG. 10B is a plan view showing the manufacturing process of bending the multiple contact point spring pieces in the manufacturing method of this invention.
Figure 10B:
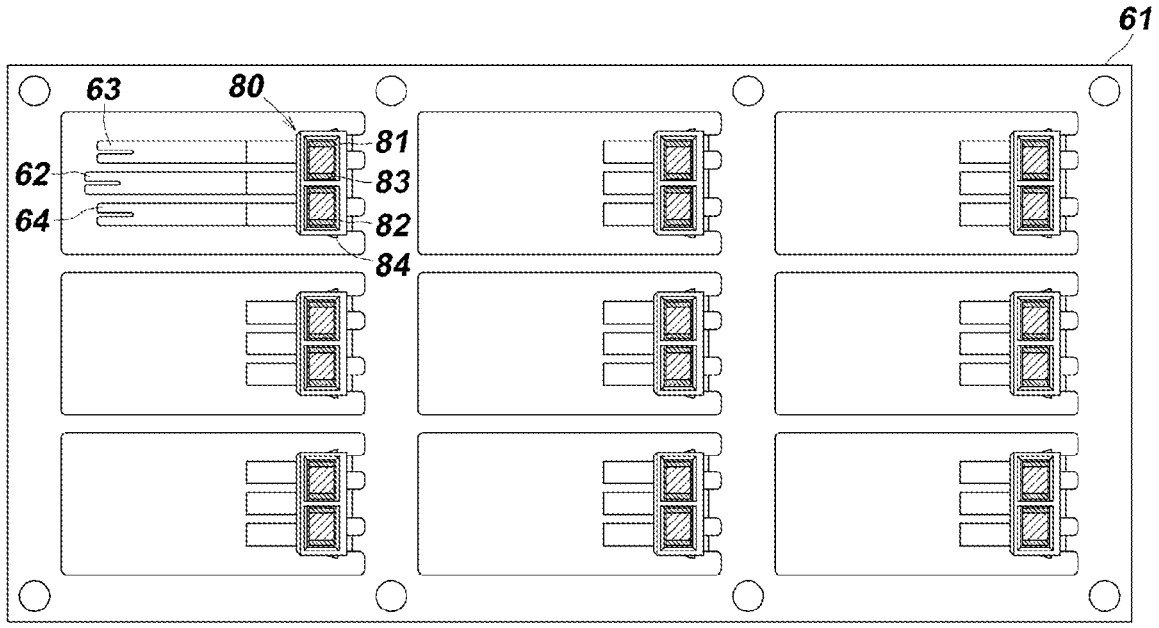
Figure 11A:
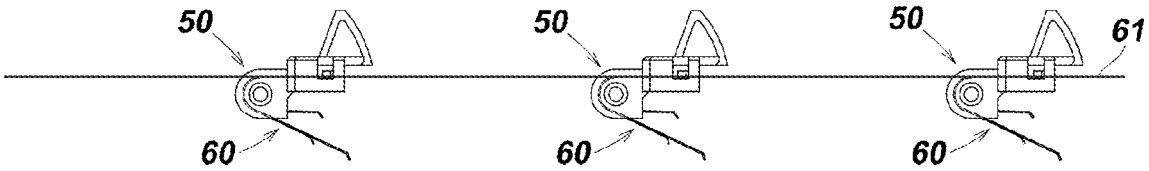
FIG. 11A is a front view.
Figure 11B:
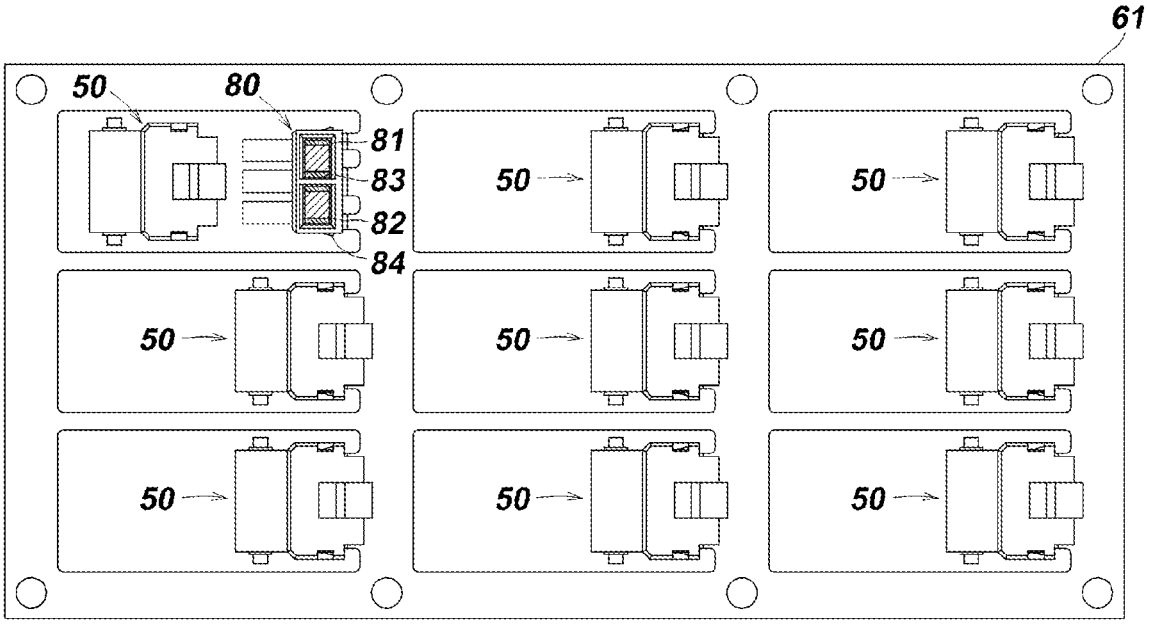
FIG. 11B is a plan view.
Figure 11C:
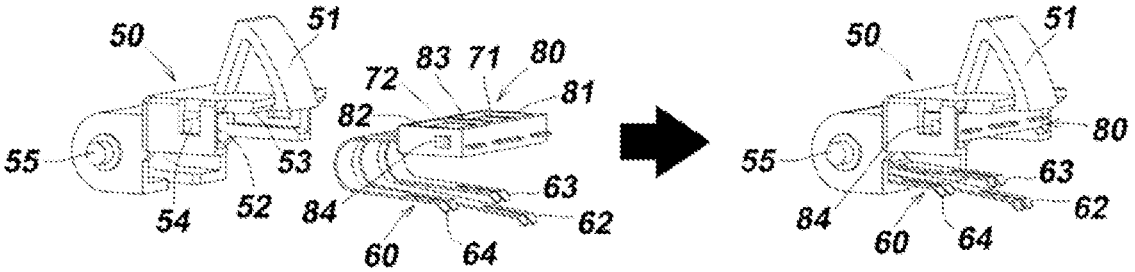
FIGs. 11C-11E are perspective views showing the manufacturing process of fitting, fixing, and integrating each mold frame of the movable contact point brush with a recessed part of a lever in the manufacturing method of this invention.
Figure 11D:
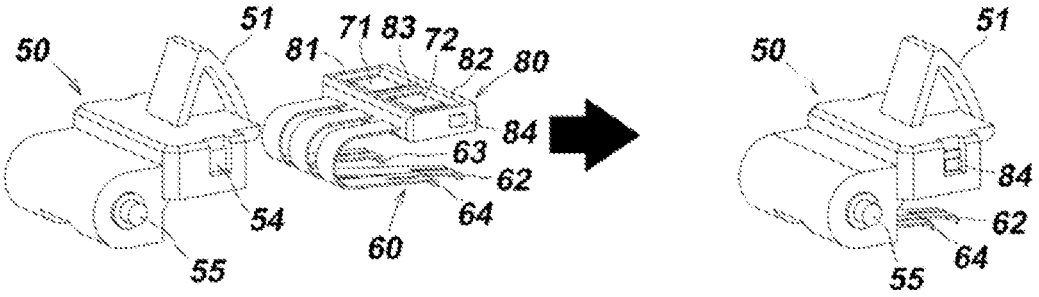
Figure 11E:
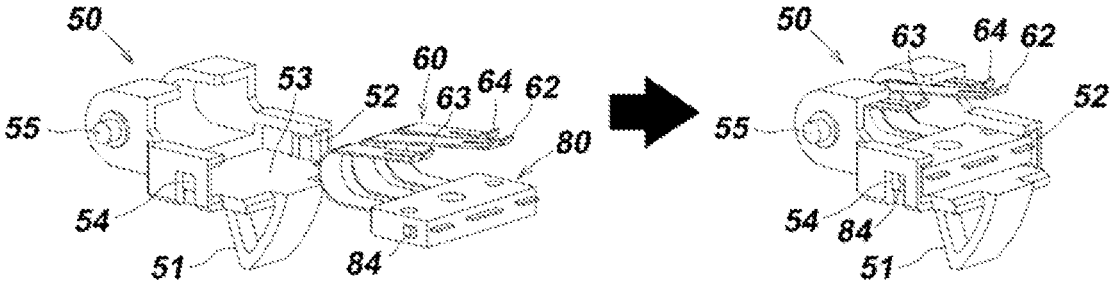

Then, as shown in FIGS. 10A and 10B, by bending the cut movable contact point pattern 61, the movable contact point brush 60 is press-molded. That is, by performing a bending process with a press to parts indicated with mountain fold lines, the common contact point spring piece 62, the first contact point spring piece 63, and the second contact point spring piece 64 are bent into a U-shape, forming the movable contact point brush 60 with each contact point having a spring force.

Furthermore, as shown in FIGS. 11A-11E, the movable contact point brush 60 and the lever 50 are integrated. The lever 50 is formed of a resin material that has an insulating property and is superior in wear resistance (a polyacetal resin in this embodiment), and comprises an operation part 51 that receives an external force, a recessed part 52 that holds the movable contact point brush 60, and a cam part 53 that transmits the external force to the movable contact point brush 60. Once the mold frame 80 integrated with the movable contact point brush 60 is inserted to the recessed part 52 of this lever 50, claws 84 on both the left and the right sides of the mold frame 80 are fitted and fixed into holes 54 on both sides of the recessed part 52, and the first contact point spring piece 63 and the second contact point spring piece 64 that are U-shaped are held in a force-accumulated state inside the recessed part 52. In this manner, because the movable contact point brush 60 and the lever 50 can be connected with one touch, the assembly labor can be simplified.

Finally, the lever 50 with the integrated movable contact point brush 60 is accommodated in the case 10. As shown in FIG. 2, once a shaft part 55 installed on the outer face of the lever 50 is inserted to a bearing 21 of the base 20, the lever 50 is supported in an inclinable manner by a prescribed angle around the shaft part 55 as a fulcrum. Then, once a top case 30 is placed over the base 20, and locking claws 22 installed on the outer face of the base 20 are fitted and fixed into locking holes 32 of the top case 30, the lever 50 with the movable contact point brush 60 having the resistors 70 attached is accommodated inside the case 10 comprising the base 20 and the top case 30. In this manner, as shown in FIG. 1, the operation part 51 of the lever 50 protrudes from an opening part 31 installed on the top plate of the top case 30, completing the brush switch SW with resistors of this embodiment.

Figure 12A:
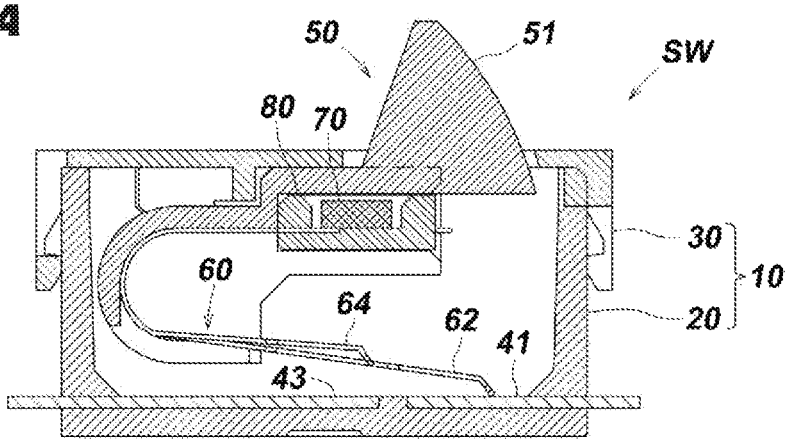
FIGS. 12A-12C are explanatory diagrams for the operations of the brush switch with resistors of this invention, where

The brush switch SW with resistors of this embodiment is configured in the above manner, where in a still free position state shown in FIG. 12A, although the common contact point spring piece 62 of the movable contact point brush 60 is in contact with the common fixed contact point 41 on the base 20, the first contact point spring piece 63, see FIG. 2, and the second contact point spring piece 64 are not in contact with the first fixed contact point 42, see FIG. 4, or the second fixed contact point 43. Thereby, the common fixed contact point 41 is not in conduction with the first fixed contact point 42 or the second fixed contact point 43, having the switch in an OFF state.

Figure 12B:
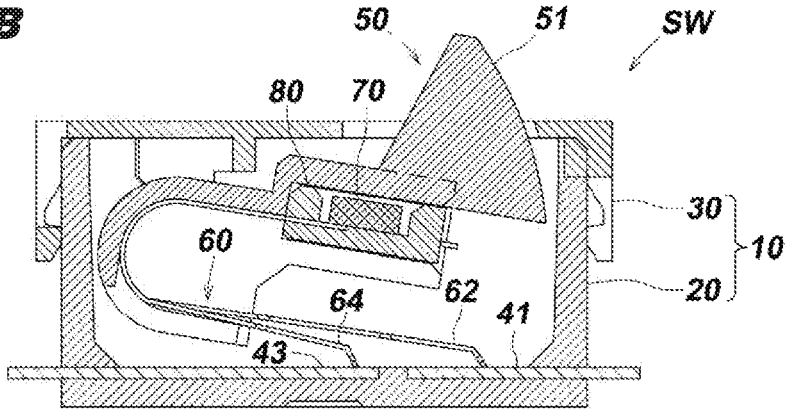
Figure 12C:
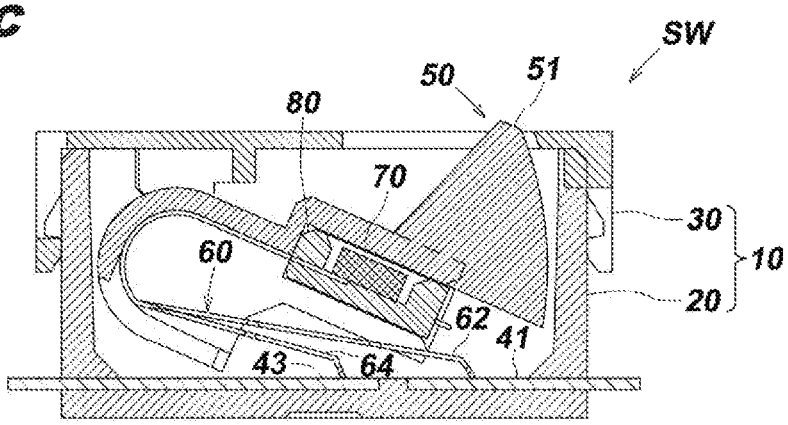

Here, once an external force acts on the lever 50, because the lever 50 falls by rotating around the shaft part 55 as the fulcrum, where the operation part 51 that receives the external force functions as a force point (or a point where the force is applied), and the cam part 53 in contact with the movable contact point brush 60 as a lever point (or a point where the force is conveyed). At this time, as in FIG. 12B, the movable contact point brush 60 is pressed by the cam part 53 and starts to be compressed, and at a fully-moved position as in FIG. 12C, the operation part 51 of the lever 50 is pushed into the interior of the case 10, then the first contact point spring piece 63 and the second contact point spring piece 64 contact with the first fixed contact point 42 and the second fixed contact point 43, respectively. Thereby, the common fixed contact point 41 comes into conduction with the first fixed contact point 42 and the second fixed contact point 43, turning the switch into an ON state.

Also, referring to FIG. 1D, the first chip resistor 71 (R1) and the second chip resistor 72 (R2) has different resistance values. Thereby, when the switch is ON, outputs of three different values of the C-A circuit (the resistance value of the first chip resistor R1), the C-B circuit (the resistance value of the second chip resistor R2), and the A-B circuit (the sum of the resistance value of the first chip resistor R1 and the resistance value of the second chip resistor R2) can be obtained. Therefore, three different functions can be controlled from the microcomputer side of the ECU circuit that reads this output.

Note that once the external force that was acting on the lever 50 is released, due to an elastic restoring force of the movable contact point brush 60, the fallen lever 50 rises up. Thereby, the movable contact point brush 60 returns to its original state, the first contact point spring piece 63 and the second contact point spring piece 64 separate from the first fixed contact point 42 and the second fixed contact point 43, and the common fixed contact point 41 is cut off conduction with the first fixed contact point 42 and the second fixed contact point 43, turning the switch into the OFF state.

As explained above, according to the brush switch SW with resistors of this embodiment, by attaching the two resistors 71 and 72 to the movable contact point brush 60 and having it built in the case 10, a manufacturing process of externally attaching resistors can be saved, and stabilization and miniaturization of the circuit can be achieved compared with a switch having resistors externally attached. Also, because the resistors 71 and 72 can be soldered in the stage of the movable contact point pattern 61, mounting troubles can be prevented, and productivity can be enhanced. Also, by integrating the movable contact point brush 60 and the lever 50, the assembly process can be simplified.

Note that although in the above-mentioned embodiment, a large number of movable contact point patterns 61 in three rows and three columns were made from a sheet of metal plate, the numbers of rows and columns can be increased as appropriate considering the production efficiency. Also, concerning the movable contact point brush 60, although the number of the contact point spring pieces (the common contact point spring piece 62, the first contact point spring piece 63, and the second contact point spring piece 64) was set to three, and two pieces of the resistors 71 and 72 were attached, by increasing the number of the contact point spring pieces and/or the number of the resistors, various detection circuits can be supported.

What is claimed is:

1. A brush switch with resistors, comprising:

a case, a fixed contact point pattern that is fixed to the case, a lever that is supported by the case such that the lever is configured to rotate, and a movable contact point brush that is movable by an operation of the lever such that the movable contact point either contacts or does not contact the fixed contact point, wherein the fixed contact point pattern has multiple fixed contact points that are disposed separately from one another in the case, and multiple terminals each of which is connected to the multiple fixed contact points, and the movable contact point brush has multiple contact point spring pieces that separate from or contact the multiple fixed contact points, respectively, and multiple resistors, which have different resistance values, that are attached to spaces between the multiple contact point spring pieces.

2. The brush switch with resistors according to claim 1, wherein the multiple resistors are made by mounting and soldering chip resistors into a mold frame that isolates the spaces between the multiple contact point spring pieces from one another.

3. The brush switch with resistors according to claim 2, wherein the movable contact point brush is integrated by fitting and fixing the mold frame to a recessed part of the lever.

* * * * *